US006109147A

United States Patent [19]

Legg

[11] Patent Number: 6,109,147

[45] Date of Patent: Aug. 29, 2000

[54] HEXAGONAL TOOL BIT SET

[75] Inventor: Larry K. Legg, Perry, Ohio

[73] Assignee: LKL Innovations, Ltd., Mentor, Ohio

[21] Appl. No.: 09/207,545

[22] Filed: Dec. 8, 1998

[51] Int. Cl.[7] ..... B25B 23/00

[52] U.S. Cl. ..... 81/440; 7/128

[58] Field of Search ..... 7/127, 128; 81/439, 81/440

[56] References Cited

U.S. PATENT DOCUMENTS

| | | | |
|---|---|---|---|
| 2,173,042 | 9/1939 | Picard . | |
| 2,405,130 | 8/1946 | Bloomfield . | |
| 2,735,325 | 2/1956 | Rudd, Sr. . | |
| 2,822,714 | 2/1958 | Paparelli . | |
| 2,951,405 | 9/1960 | Engquist . | |
| 3,127,798 | 4/1964 | Gol . | |
| 5,062,173 | 11/1991 | Collins et al. | 7/128 X |
| 5,287,778 | 2/1994 | Cook . | |
| 5,491,856 | 2/1996 | Legg | 7/128 |
| 5,592,859 | 1/1997 | Johnson et al. . | |

*Primary Examiner*—James G. Smith
*Attorney, Agent, or Firm*—Renner, Otto, Boisselle & Sklar LLP

[57] ABSTRACT

A tool providing a plurality of tool bits, each having a different polygonal (i.e. hexagonal) external contour. The tool includes an inner member and an outer sleeve member. The inner member defines a small tool bit having a polygonal external contour. The outer sleeve member includes a cavity that selectively receives the inner member. The inner member and the outer sleeve member together define, when the inner member is received within the cavity, a large tool bit having a polygonal external contour of the same shape, but a larger size, than the inner tool bit. In this manner, the small tool bit may be used when the inner member is withdrawn from the cavity and the large tool bit may be used when the inner member is received within the cavity.

20 Claims, 3 Drawing Sheets

HEXAGONAL TOOL BIT SET

FIELD OF THE INVENTION

This invention relates generally to a tool that provides a set of tool bits each having a different sized polygonal (i.e., hexagonal) external contour.

BACKGROUND AND SUMMARY OF THE INVENTION

A hexagonal wrench, also referred to as an allen wrench, comprises a tool bit having a hexagonal external contour. The tool bit is used, for example, to loosen and/or tighten a screw having a socket with an internal contour matching the tool bit's external contour. Since such screws and/or their sockets come in many different sizes, hexagonal wrenches are manufactured in many different sizes. Also, they are often sold in a set including a plurality of different sized hexagonal tool bits.

Many hexagonal wrench sets are designed to be stored in one location, such as a tool chest, so that they can be withdrawn and used for the tooling task presented. For example, a wrench set can include a plurality of different sized hexagonal wrenches that are unconnected but stored in a common container or box. Alternatively, a wrench set can include a plurality of different sized hexagonal tool bits arranged in a telescoping manner. These types of wrench sets work quite well in some situations, such as an industrial work station or a home work bench.

During day-to-day activities, tasks are sometimes encountered which require the use of a hexagonal wrench. While one alternative is to wait until returning home/work to perform the task, having the wrench available for immediate use is the more preferable option. Additionally or alternatively, tasks requiring the use of a hexagonal wrench often occur while traveling. With particular reference to outdoor travel activities such as camping, hiking, and biking, different sized hexagonal wrenches may be necessary to set-up camp and/or maintain equipment. While traveling with a bulky wrench set is one solution, this is probably not practical since most travelers (especially campers, hikers, and bikers) prefer to pack as light as possible.

The present invention pertains to a tool providing a plurality of different sized hexagonal tool bits. The tool is preferably constructed to be convenient to carry at almost all times, such as in a person's pocket or purse. Moreover, the tool according to the present invention may prove useful in other environments, such as an industrial work station or a home work bench, where space is not necessarily at a premium.

More particularly, the present invention provides a tool comprising an inner member and an outer sleeve member. The inner member defines a small tool bit having a polygonal (preferably hexagonal) external contour. The outer sleeve member includes a cavity that selectively receives the inner member. The inner member and the outer sleeve member together define, when the inner member is received within the cavity, a large tool bit. The large tool bit has a polygonal (preferably hexagonal) external contour of the same shape, but of a larger size, than the inner tool bit. In this manner, the small tool bit may be used when the inner member is withdrawn from the cavity and the large tool bit may be used when the inner member is received within the cavity.

In the preferred embodiment, the inner member includes a proximate supporting portion and a distal portion defining the small tool bit. The outer sleeve member includes a proximate supporting portion and a distal portion that, along with the distal portion of the inner member, defines the large tool bit. The supporting portions are pivotally connected together so that the inner member may be selectively pivoted for insertion into, and withdrawal from, the cavity of the outer sleeve member.

As was indicated above, the polygonal external contours of the tool bits are preferably hexagonal contours, and more particularly hexagonal contours each having six equally-sized sides. The distal portion of the outer sleeve member may completely form all but two sides of the polygonal external contour of the large tool bit. The inner tool bit may form the missing portions of the two sides. Consequently, the small and large tool bits will be non-concentrically arranged when the inner member is received in the cavity of the outer sleeve member.

The tool may further comprise a base to which the inner member and the outer sleeve member are connected, and more preferably pivotally connected. The base may include portions which cooperate to form an aperture selectively openable to receive a keyring. In this manner, the tool may be stored in a person's pocket or purse and then released from the keyring for use when a tooling task presents itself. The base may also includes portions which cooperate to prevent the aperture from accidently opening and unintentionally releasing the keyring.

In order to provide more hexagonal tool bits (preferably all of different sizes), further pairs of inner members and outer sleeve members may be connected to the base. Additionally or alternatively, another outer sleeve member may be provided that has a cavity for receiving the first outer sleeve member. In the latter modification, the inner member, the first outer sleeve member, and the second outer sleeve member would together define a larger tool bit when the inner member is received within the cavity of the first outer sleeve member and when the first outer sleeve member is received within the cavity of the second outer sleeve member. The larger tool bit would have a polygonal (preferably hexagonal) external contour of the same shape, but of a larger size, than the large tool bit.

The tool according to the present invention may be used to loosen and/or tighten screws having sockets of different sizes. Specifically, the inner member would be withdrawn from the cavity of the outer sleeve member to use the small tool bit to loosen/tighten a screw having a correspondingly sized socket. The inner member would then be returned to the cavity of the outer sleeve member so that the large tool bit could be used to loosen/tighten a screw having a correspondingly sized socket.

These and other features of the invention are fully described and particularly pointed out in the claims. The following descriptive annexed drawings set forth in detail certain illustrative embodiments of the invention, these embodiments being indicative of but a few of the various ways in which the principles of the invention may be employed.

DRAWINGS

DETAILED DESCRIPTION

Figures 1, 2, 3, 3A:
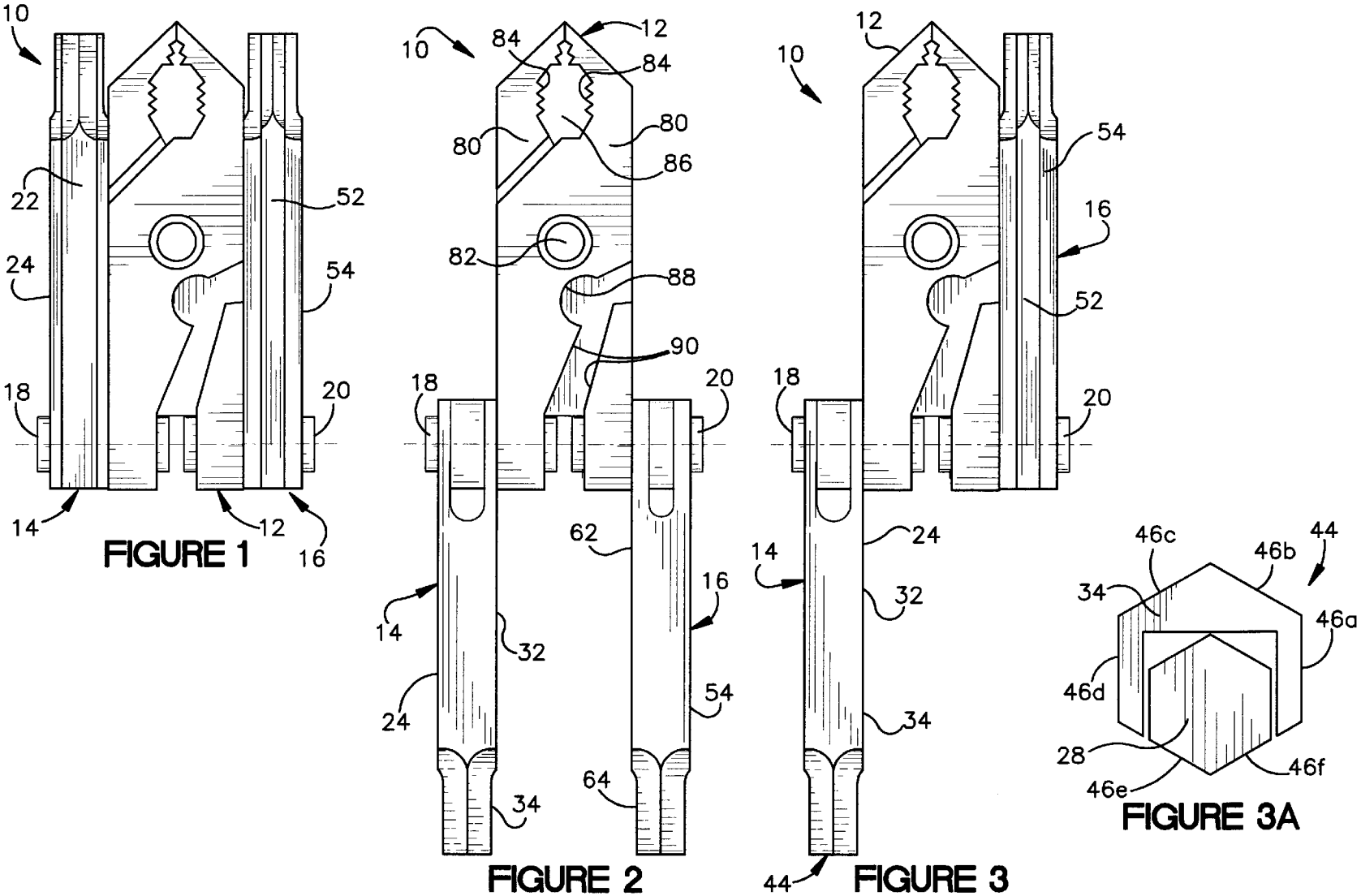
FIG. 1 is a top view of a tool according to the present invention, the tool including two handles each including an outer sleeve member and an inner member, both of the handles being shown in a folded position.
FIG. 2 is a top view of the tool with both handles in an extended position.
FIG. 3 is a top view of the tool with one handle in an extended position.
FIG. 3A is an enlarged end view of the extended handle.

Referring now to the drawings, and initially to FIGS. 1 and 2, a tool 10 according to the present invention is shown. The tool 10 is preferably constructed of rigid material sufficient for performing the tool's various functions. The material may take the form of metal although some non-metal materials could possibly be employed.

As is explained in more detail below, the tool 10 provides a plurality of different sized hexagonal tool bits. The tool 10 is preferably constructed so that it is convenient to carry at almost all times. In this manner, the tool 10 will be readily available when a tooling task requiring a hexagonal tool bit presents itself.

The tool 10 includes a base 12, a first handle 14 and a second handle 16. A first pivot pin 18 extends through cooperating apertures in the base 12 and the handle 14 to provide a pivotal connection therebetween. A second pivot pin 20 extends through cooperating apertures in the base 12 and the handle 16 to provide a pivotal connection therebetween. In this manner, the handles 14 and 16 may be selectively pivoted relative to the base 12 between a folded position and an extended position. For example, both of the handles 14 and 16 may be placed in the folded position (FIG. 1) and both of the handles may be placed in the extended position (FIG. 2).

The first handle 14 includes an inner member 22 and an outer sleeve member 24. The inner member 22 includes a proximate supporting portion 26 and a distal portion 28. The sleeve member 24 defines a cavity 30 sized and shaped to receive the inner member 22. (See FIG. 4.) To this end, the sleeve member 24 includes a proximate supporting portion 32 and a distal portion 34. The supporting portion 32 defines a proximate portion of the cavity 30 which receives the supporting portion 26 of the inner member 22. The distal portion 34 defines a distal portion of the cavity 30 which receives the distal portion 28 of the inner member 22.

Figure 4A:
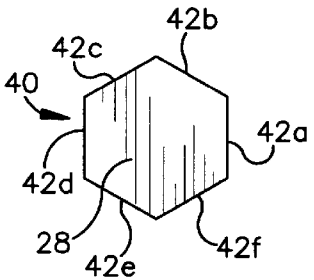
FIG. 4A is an enlarged end view of the extended inner member.
Figure 4:
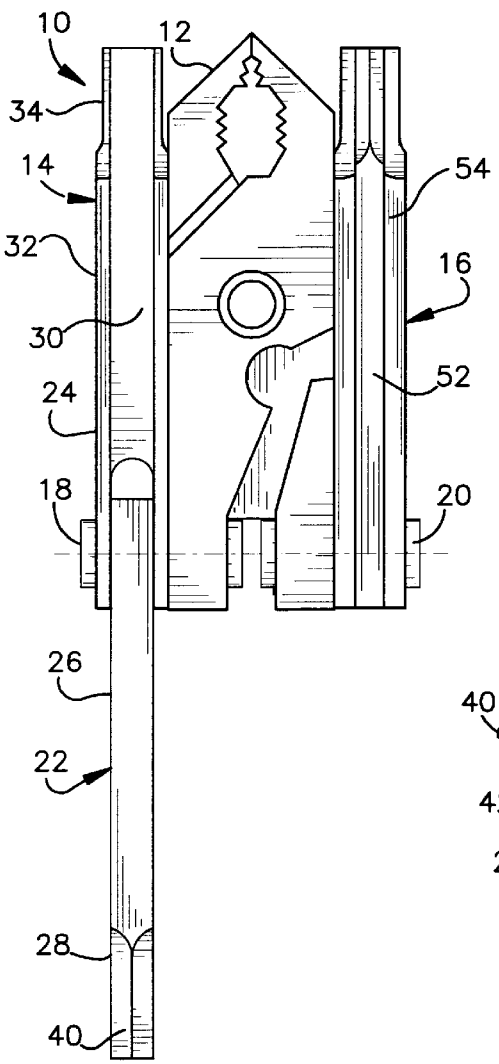
FIG. 4 is a top view of the tool with the one handle in the folded position but the inner member thereof in an extended position.
Figure 6A:
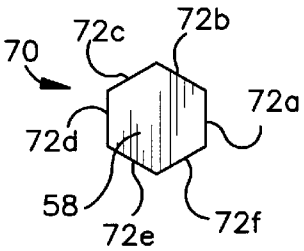
FIG. 6A is an enlarged end view of the extended inner member.

The proximate ends of the supporting portions 26 and 32 are pivotally coupled to each other, and the base 12, via the pivot pin 18. In this manner, the inner member 22 and the outer sleeve member 24 may together be placed in an extended position relative to the base 12, as is shown in FIG. 3. Also, only the inner member 22 may be placed in an extended position relative the base 12, as is shown in FIG. 4.

The proximate supporting portion 26 of the inner member 22 is roughly rectangular (or square) in cross-sectional shape. The proximate supporting portion 32 of the outer sleeve member 24 is shaped to receive this rectangular portion in a non-concentric manner. The supporting portions 26 and 32 together form a structure that is rectangular (or square) in cross-sectional shape but of larger dimensions than the inner supporting portion 26. Specifically, the supporting portion 32 of the outer sleeve member 24 forms three of the four sides, and also the corners of the missing fourth side. The supporting portion 26 of the inner member 22 forms the non-corner regions of the fourth side.

The distal portion 28 of the inner member 22 defines a small tool bit 40 having sides 42 forming a polygonal external contour. The inner distal portion 28 and the outer distal portion 34 together define, when the inner member 22 is received within the cavity 30, a large tool bit 44. The large tool bit 44 has sides 46 forming a polygonal external contour. In the context of the present application, the terms "large" and "small" simply refer to the size of the tool bits 40 and 44 relative to each other.

The large tool bit 44 may be used when the inner member 22 and the outer sleeve member 24 are placed in the extended position as is shown in FIG. 3. The small tool bit 40 may be used when only the inner member 22 is placed in the extended position as is shown in FIG. 4.

The small tool bit 40 preferably has a plurality of equally-sized sides and more preferably six equally-sized sides 42*a*, 42*b*, 42*c*, 42*d*, 42*e*, and 42*f* thereby forming a hexagonal external contour or an alien wrench. (FIG. 4A.) The large tool bit 44 preferably has a plurality of equally-sized sides and more preferably six equally-sized sides 46*a*, 46*b*, 46*c*, 46*d*, 46*e*, and 46*f* thereby also forming a hexagonal external contour or an allen wrench. (FIG. 3A.) Thus, the large tool bit 44 has a polygonal external contour of the same shape, but of a larger size, than the inner tool bit 40.

Accordingly, the distal portion 28 of the inner member 22 is hexagonal in cross-sectional shape and the distal portion 34 of the outer sleeve member 24 is shaped to receive this hexagonal shape in a non-concentric manner. Also, the distal portions 28 and 34 together form a structure having the same hexagonal cross-sectional shape, but larger dimensions, than the inner distal portion 28. Preferably, the distal portion 28 of the outer sleeve member 24 completely forms the four sides 46*a*, 46*b*, 46*c*, and 46*d* and also the corners of the fifth and six sides 46*e* and 46*f*. The distal portion 28 of the inner member 22 (and particularly its sides 42*e* and 42*f*) forms the missing regions of the fifth side 46*e* and the sixth side 46*f*.

Accordingly, when using the tool 10 to loosen and/or tighten screws, the inner member 22 is withdrawn from the cavity 30 of the outer sleeve member 24 and preferably pivoted to the extended position. (FIG. 4.) The small tool bit 40 may be used to loosen and/or tighten a screw having a socket with an internal contour matching the external contour of the small tool bit 40. The inner member 22 would then be returned to the cavity 30 of the outer sleeve member 24. (FIG. 1.)

To use the large tool bit 44, the sleeve member 24 (with the inner member 22 contained within its cavity 30) would be pivoted to the extended position. (FIG. 3.) The large tool bit 44 could then be used to loosen and/or tighten a screw having a socket opening with an internal contour matching the external contour of the large tool bit 44.

Figure 5A:
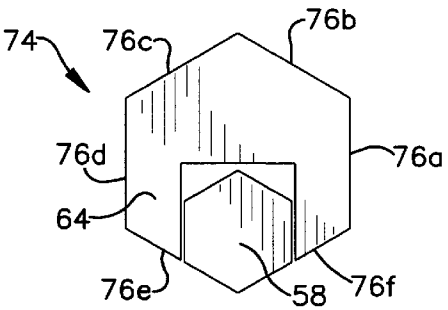
FIG. 5A is an enlarged end view of the extended handle.
Figure 5:
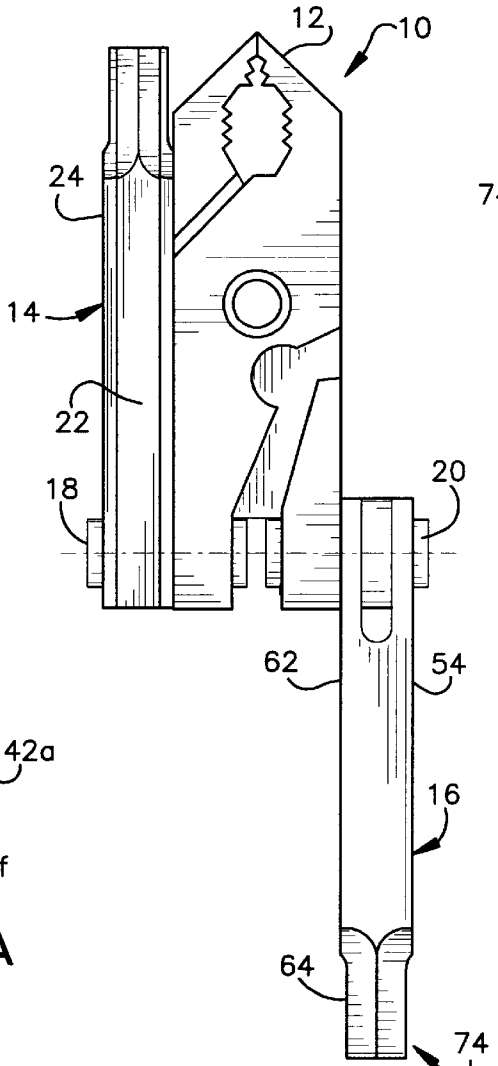
FIG. 5 is a top view of the tool with the other handle in an extended position.
Figure 6:
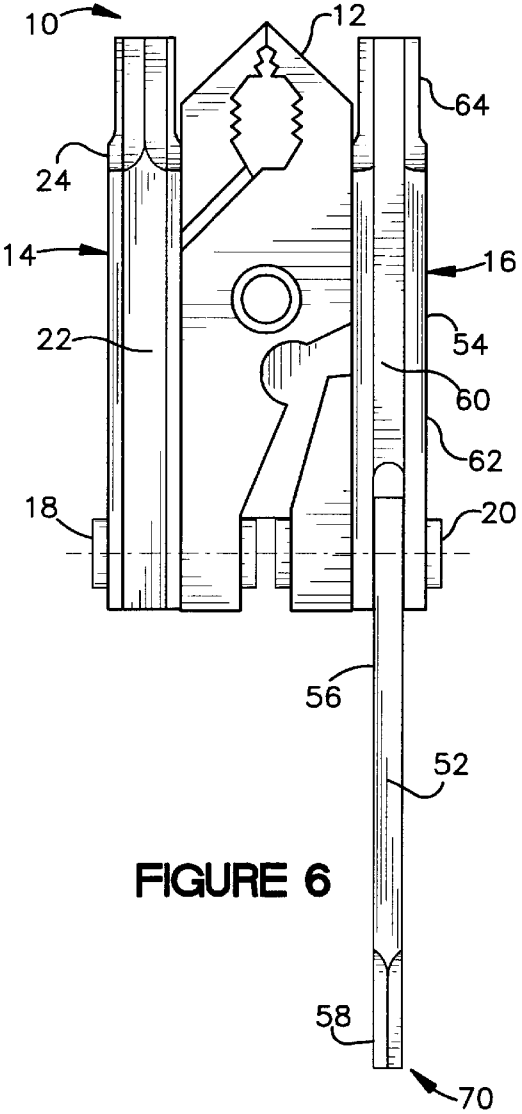
FIG. 6 is a top view of the tool with the other handle in the folded position but the inner member thereof in an extended position.

The handle 16 is constructed in essentially the same manner as the handle 14 and includes inner member 52 and an outer sleeve member 54 pivotally connected to each other and the base 12 by the pivot pin 20. In this manner, the inner member 52 and the outer sleeve member 54 may together be placed in an extended position relative to the base 12, as is shown in FIG. 5. Also, only the inner member 52 may be placed in an extended position relative the base 12, as is shown in FIG. 6.

The inner member 52 includes a supporting portion 56 and a distal portion 58. The sleeve member 54 defines a cavity 60 for receiving the inner member 52 and includes a supporting portion 62 and a distal portion 64. The inner distal portion 58 defines a small tool bit 70 having polygonal sides 72. The distal portions 58 and 64 together define, when the inner member 52 is received within the cavity 60, a large tool bit 74 having polygonal sides 76. Preferably, the tool bits 70 and 74 have the same hexagonal shape as the bits 40 and 44. However, the small tool bit 60 is preferably of a different size than the small tool bit 40 and the large tool bit 64 is preferably of a different size than the large tool bit 44. In this manner, the tool 10 may provide four different sizes of hexagonal tool bits or allen wrenches.

The base 12 of the illustrated tool 10 is similar to the analogous component (namely a first elongated member 12) disclosed in U.S. Pat. No. 5,491,856, the entire disclosure of which is hereby incorporated by reference. As is best seen by referring back to FIG. 2, the base 12 includes a pair of gripping jaws 80. A pivot pin 82 extends through cooperating apertures in the gripping jaws 80 for providing a pivotal connection therebetween. The pivot axis of the pin 82 is perpendicular to the pivot axis of the pins 18 and 20 and, in any event, is located intermediate the ends of the gripping jaws 80.

The gripping jaws 80 each include at one end thereof a serrated edge 84 to provide interacting gripping surfaces. The gripping jaws 80 may pivot relative to each other between a closed position as shown in FIG. 1 and an open position (not shown) at which the jaws are spaced from each other.

When the gripping jaws 80 are in the closed position, arcuate recesses adjacent the serrated edges 84 together form an aperture 86. When the gripping jaws 80 are open, the aperture 86 may receive a keyring. Accordingly, the base 12 includes portions which cooperate to form an aperture 86 selectively openable to receive a keyring.

When at least one of the handles 14 and 16 is in its folded position (FIGS. 1, 3 and 5) and/or when at least one of the outer sleeve members 24 and 54 is in its folded position (FIGS. 4 and 6), the gripping jaws 80 are locked and prevented from opening. This assures that the keyring will not be inadvertently released from the aperture 86. Accordingly, the base 12 also includes portions which cooperate to prevent the aperture 86 from accidently opening and the jaws 80 unintentionally releasing the keyring.

The gripping jaws 80 each include at another end thereof (the end opposite the serrated edge 84) a semi-circular notch 88. These notches 88 cooperate to form a device for gripping, stripping and/or cutting wires. Additionally, the gripping jaws 80 each include an angled blade edge 90 which, when used in conjunction with each other, form a scissors-like cutting device.

In the illustrated embodiment, the inner member 22 and the outer sleeve member 24, and/or the inner member 52 and the outer sleeve member 54, are incorporated into the handles 14 and 16 of the tool 10. The handles 14 and 16 are pivotally mounted to the base 12 which, in the illustrated embodiment, includes gripping jaws, cutting edges, and/or wire strippers. However, the tool 10 could include a base of a different design, such as one that does not provide any supplemental tooling functions. Additionally or alternatively, the members 22 and 24 (and/or the members 52 and 54) need not be incorporated into handles. Furthermore, the members 22 and 24 (and/or the members 52 and 54) do not necessarily have to be mounted to a base. A different-design base tool, a handle-less tool, and even a base-less tool is possible with, and contemplated by, the present invention.

Figure 7:
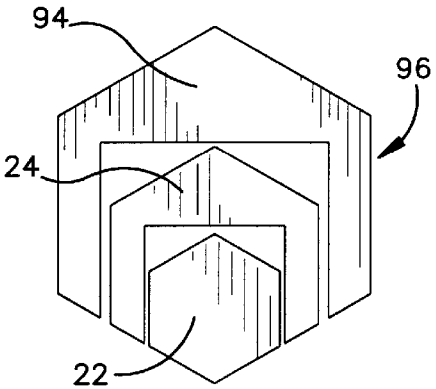
FIG. 7 is an enlarged end view of a modified form of the tool including a second outer sleeve member.

Moreover, the tool 10 need not be limited to one outer sleeve member for each inner member 22. For example, if the outer sleeve member 24 is viewed as the first outer sleeve member, a second outer sleeve member 94 could be provided such as is shown in FIG. 7. The second outer sleeve member 94 would define a cavity sized and shaped to receive the first outer sleeve member 24. The inner member 22, the first outer sleeve member 24, and the second outer sleeve member 94 would together define a larger tool bit 96 when the inner member 22 is received within the cavity of the first sleeve member 24 and when the first sleeve member 24 is received within the cavity of the second sleeve member 94. The larger tool bit 96 would have a polygonal external contour of the same shape, but a larger size, than the small tool bit 40 and the large tool bit 44.

One may now appreciate that the tool 10 according to the present invention provides a plurality of different sized hexagonal tool bits 40, 44, 70, 74 and/or 96. The tool 10 is preferably compactly constructed so that it is convenient to carry at almost all times. However, compact and non-compact versions of the tool 10 may prove useful in other situations, such as an industrial work station or a home work bench, where space is not necessarily at a premium.

Although the invention has been shown and described with respect to certain preferred embodiments, it is obvious that equivalent and obvious alterations and modifications will occur to others skilled in the art upon the reading and understanding of this specification. The present invention includes all such alterations and modifications and is limited only by the scope of the following claims.

What is claimed is:

1. A tool comprising an inner member and an outer sleeve member;

the inner member defining a small tool bit having a polygonal external contour;

the outer sleeve member including a cavity that selectively receives the inner member;

the inner member and the outer sleeve member together defining, when the inner member is received within the cavity, a large tool bit having a polygonal external contour of the same shape, but a larger size, than the small tool bit, and having a working end formed by both the inner member and the outer sleeve member;

whereby the small tool bit may be used when the inner member is withdrawn from the cavity and whereby the large tool bit may be used when the inner member is received within the cavity.

2. A tool as set forth in claim 1 wherein the members are non-concentrically arranged when the inner member is received in the cavity of the outer sleeve member.

3. A tool comprising an inner member and an outer sleeve member;

the inner member defining a small tool bit having a polygonal external contour;

the outer sleeve member including a cavity that selectively receives the inner member;

the inner member and the outer sleeve member together defining, when the inner member is received within the cavity, a large tool bit having a polygonal external contour of the same shape, but a larger size, than the small tool bit;

whereby the small tool bit may be used when the inner member is withdrawn from the cavity and whereby the large tool bit may be used when the inner member is received within the cavity;

wherein the members are non-concentrically arranged when the inner member is received in the cavity of the outer sleeve member;

wherein:

the inner member includes a proximate supporting portion and a distal portion and the outer sleeve member includes a proximate supporting portion and a distal portion;

the distal portion of the inner member defines the small tool bit;

the distal portion of the outer sleeve member, along with the distal portion of the inner member, defines the large tool bit; and the supporting portions are pivotally connected together so that the inner member may be selectively pivoted for insertion into and withdrawal from the cavity of the outer sleeve member.

4. A tool as set forth in claim 3 wherein the distal portion of the outer sleeve member completely forms all but two sides of the polygonal external contour of the large tool bit; and wherein the small tool bit forms the missing regions of the two sides.

5. A tool comprising an inner member and an outer sleeve member;

the inner member defining a small tool bit having a polygonal external contour;

the outer sleeve member including a cavity that selectively receives the inner member;

the inner member and the outer sleeve member together defining, when the inner member is received within the cavity, a large tool bit having a polygonal external contour of the same shape, but a larger size, than the small tool bit;

whereby the small tool bit may be used when the inner member is withdrawn from the cavity and whereby the large tool bit may be used when the inner member is received within the cavity;

wherein a distal portion of the outer sleeve member completely forms all but two sides of the polygonal external contour of the large tool bit; and wherein the small tool bit forms the missing regions of the two sides.

6. A tool comprising an inner member and an outer sleeve member;

the inner member defining a small tool bit having a polygonal external contour;

the outer sleeve member including a cavity that selectively receives the inner member;

the inner member and the outer sleeve member together defining, when the inner member is received within the cavity, a large tool bit having a polygonal external contour of the same shape, but a larger size, than the small tool bit;

whereby the small tool bit may be used when the inner member is withdrawn from the cavity and whereby the large tool bit may be used when the inner member is received within the cavity;

wherein the members are non-concentrically arranged when the inner member is received in the cavity of the outer sleeve member;

wherein a distal portion of the outer sleeve member completely forms all but two sides of the polygonal external contour of the large tool bit; and wherein the small tool bit forms the missing regions of the two sides.

7. A tool as set forth in claim 1 wherein the polygonal external contours each have a plurality of equally-sized sides.

8. A tool as set forth in claim 1 wherein the polygonal external contours are hexagonal contours each having six equally-sized sides.

9. A tool as set forth in claim 2 wherein the polygonal external contours are hexagonal contours each having six equally-sized sides.

10. A tool comprising an inner member and an outer sleeve member;

the inner member defining a small tool bit having a polygonal external contour;

the outer sleeve member including a cavity that selectively receives the inner member;

the inner member and the outer sleeve member together defining, when the inner member is received within the cavity, a large tool bit having a polygonal external contour of the same shape, but a larger size, than the small tool bit;

whereby the small tool bit may be used when the inner member is withdrawn from the cavity and whereby the large tool bit may be used when the inner member is received within the cavity;

wherein the members are non-concentrically arranged when the inner member is received in the cavity of the outer sleeve member;

wherein the polygonal external contours are hexagonal contours each having six equally-sized sides;

wherein the distal portion of the outer sleeve member completely forms all but two sides of the hexagonal external contour of the large tool bit; and wherein the small tool bit forms the missing regions of the two sides.

11. A tool as set forth in claim 3 further comprising a base to which the inner member and the outer sleeve member are connected.

12. A tool as set forth in claim 11 wherein the inner member and the outer sleeve member are pivotally connected to the base.

13. A tool as set forth in claim 11 wherein the base includes portions which cooperate to form an aperture selectively openable to receive a keyring.

14. A tool as set forth in claim 13 wherein the base also includes portions which cooperate to prevent the aperture from accidently opening and unintentionally releasing the keyring.

15. A tool as set forth in claim 12 further comprising a second inner member and a second outer sleeve member connected to the base;

the second outer sleeve member having a cavity that selectively receives the second inner member;

the second inner member defining a second small tool bit having a polygonal external contour of a different size than the first small tool bit;

the second inner member and the second outer sleeve member together defining, when the second inner member is received within the cavity, a second large tool bit having a polygonal external contour profile of the same shape, but a larger size, than the second small tool bit and of a different size than the first large tool bit;

whereby the second small tool bit may be used when the second inner member is withdrawn from the cavity and whereby the second large tool bit may be used when the second inner member is received within the second sleeve member's cavity.

16. A tool as set forth in claim 15 wherein the second inner member and the second outer sleeve member are pivotally connected to the base.

17. A tool as set forth in claim 1, wherein the outer sleeve member is a first outer sleeve member, and wherein the tool further comprises a second outer sleeve member having a cavity that receives the first outer sleeve member and wherein the inner member, the first outer sleeve member, and the second outer sleeve member together define, when the inner member is received within the cavity of the first outer sleeve member and the first outer sleeve member is received within the cavity of the second outer sleeve member, a larger tool bit having a polygonal external contour of the same shape, but larger size, than the large tool bit.

18. A tool as set forth in claim 17 wherein the inner member, the first outer sleeve member and the second outer sleeve member are non-concentrically arranged when the inner member is received in the cavity of the first outer sleeve member and the first outer sleeve member is received in the cavity of the second outer sleeve member.

19. A tool as set forth in claim 18 wherein the polygonal external contours are hexagonal contours each having six equally-sized sides.

20. A tool as set forth in claim 19 wherein:

wherein the first outer sleeve member completely forms all but two sides of the hexagonal external contour of the large tool bit and the small tool bit forms the missing regions of these two sides of the large tool bit; and wherein the second outer sleeve member completely forms all but two sides of the hexagonal external contour of the larger tool bit and the first outer sleeve member and the inner member forms the missing regions of these two sides of the larger tool bit.

* * * * *